United States Patent [19]

Taylor

[11] Patent Number: 4,947,435

[45] Date of Patent: Aug. 7, 1990

[54] METHOD OF TRANSFER FUNCTION GENERATION AND ACTIVE NOISE CANCELLATION IN A VIBRATING SYSTEM

[76] Inventor: Brian A. Taylor, Felixstowe, England

[21] Appl. No.: 173,677

[22] Filed: Mar. 25, 1988 (Under 37 CFR 1.47)

[51] Int. Cl.[5] ..... G10K 11/16

[52] U.S. Cl. ..... 381/71

[58] Field of Search ..... 381/71, 94

[56] References Cited

U.S. PATENT DOCUMENTS 4,122,303 10/1978 Chaplin .
4,153,815 5/1979 Chaplin .
4,417,098 11/1983 Chaplin .
4,435,751 3/1984 Hori .
4,473,906 9/1984 Warnaka .
4,489,441 12/1984 Chaplin .
4,490,841 12/1984 Chaplin .
4,527,282 7/1985 Chaplin .
4,562,589 12/1985 Warnaka .
4,566,118 1/1986 Chaplin .
4,600,863 7/1986 Chaplin .
4,654,871 3/1987 Chaplin .

OTHER PUBLICATIONS

Chaplin "Anti-noise-The Essex Breakthrough", CME, Jan. 1983, pp. 41-47.

*Primary Examiner*—Forester W. Isen

[57] ABSTRACT

A method for the active cancellation of an incident vibration field (N(iω)) wherein a cancelling vibration field (C(iω)) is superposed on the incident field to create a residual vibration field (R(iω)). The residual field is operated on with a transfer function to obtain an updated cancelling field, the transfer function being divided by a reference point (10) into an upstream part (Fi(iω)) and a downstream part (Fo(iω)). The downstream part (Fo(iω)) of the transfer function is periodically updated by multiplying the last obtained value ($Fo_n(i\omega)$) by a factor which is the ratio of a computational value of the last cancelling field ($C_n(i\omega)$) and a computational value for the sum of previous residual fields (R(iω)).

10 Claims, 2 Drawing Sheets

METHOD OF TRANSFER FUNCTION GENERATION AND ACTIVE NOISE CANCELLATION IN A VIBRATING SYSTEM

BACKGROUND OF THE INVENTION

This invention relates to an improved method of generating a transfer function and thus to a method of, and apparatus for, active cancellation of vibration in a system subject to vibration. The invention is applicable to the cancellation of vibrations propagating in gas(es), liquid(s) or solid(s) or in any combination of these media. Reduction (and at best substantial removal) of noise to create a quiet zone is one particularly important aspect of the invention.

DISCUSSION OF PRIOR ART

Except in certain circumstances (virtual earth or tight-coupled monopole) most active vibration control systems which generate the required cancelling vibration from a sensing of the signature of the incident vibration it is desired to cancel, require a knowledge of the transfer function of the system media and elements of the cancelling system. Depending on the approach, the cancelling algorithm and transfer function may be in the time domain (as described in GB-A-1555760), the frequency domain (as described in GB-A-2107960), or any suitably mathematically formed transformation.

The transfer function can be measured in advance and written into the algorithm, it can be measured immediately prior to cancellation or it can be measured during cancellation. The last mentioned approach lends itself to a system which can better adapt to changing conditions affecting the transfer function.

The prior art approach has been to generate the transfer function by inputting some vibration into the system. This vibration can be discrete tones, a swept sine wave, random vibrations (which may be white noise), or an impulse and measuring the system response in the relevant time- or transformed-domain. The problem with these prior art approaches is that, although they do generate an explicit transfer function, they actually increase the vibration in the system media during the period when the transfer function is being generated or adapted.

An apternative approach is that described in US-A-4435751 (Hitachi) which finds the transfer function implicitly by a trial and error method. GB-A-2107960 mentions a method of updating the transfer function during cancellation, but this is not a general method.

The present invention relates to a truly adaptive means of generating an initial transfer function for a system which is able to update the transfer function during cancellation without introducing appreciable additional vibration into the system. The invention thus also updates the content of the cancelling signal. Both of these updates are achieved by monitoring the residual vibration in the system.

SUMMARY OF THE INVENTION

Expressed in one aspect a method for the active cancellation of an incident vibration field which comprises superposing on the incident field a cancelling vibration field to create a residual vibration field and operating on the residual field with a transfer function to obtain an updated cancelling field, is characterised in that the transfer function is divided by a reference point into an upstream part and a downstream part and that the downstream part of the transfer function is periodically updated by multiplying the last obtained value by a factor which is the ratio of a computational value of the last cancelling field and a computational value for the sum of previous residual fields.

Expressed in a further aspect a method of updating the transfer function used in a transformed domain to determine a cancelling vibration field which when superposed on an incident vibration field will produce a residual vibration field, the updating being effected so as to decrease the residual vibration field, is characterised in that said method comprises multiplying the existing value of the transfer function in the transformed domain by an updating factor which is the ratio of the existing value of the cancelling field in the transformed domain to the sum of all significant values of the residual field in the transformed domain.

In its main apparatus aspect, the invention relates to apparatus for cancelling vibrations entering a given location from a source of repetitive vibrations comprising means to monitor the repetition rate at which the source is emitting said vibrations, a first electromechanical transducer to generate a secondary vibration and to feed. the same to said location, a second electro-mechanical transducer to monitor the resultant vibrations existing at said location due to interaction there between said primary and secondary vibrations, and an electronic digital processing circuit linking said first and second transducers, which circuit includes synchronising means receiving an electrical signal train from said rate monitoring means, said digital processing circuit linking said second and first transducers including a first transform module receiving time waveform samples from the second transducer and generating independent pairs of components at each of a plurality of different frequency locations of the time waveform samples, a processor for separately modifying the independent pairs at each said frequency location outputting from the first transform module and feeding the modified pairs of components to a second transform module, said second transform module generating further time waveform samples which are fed as input to the first transducer, which apparatus is characterised in that between said first and second transform modules said digital processing circuit includes a first region in which the current transform domain representation of the secondary vibration is stored, a second region in which a transformed domain representation of the sum of earlier differences between primary and secondary vibrations is stored, and a third region in which a ratio between the data in the first and second regions is obtained.

Desirably the transform modules are commercially available Fourier transformers and the data stored includes information defining the amplitude and phase at a plurality of discrete frequencies.

BRIEF DESCRIPTION OF DRAWINGS

The invention will now be described, by way of example, with reference to the accompanying drawings, in which.

DESCRIPTION OF THE PREFERRED EMBODIMENTS

Figure 1:
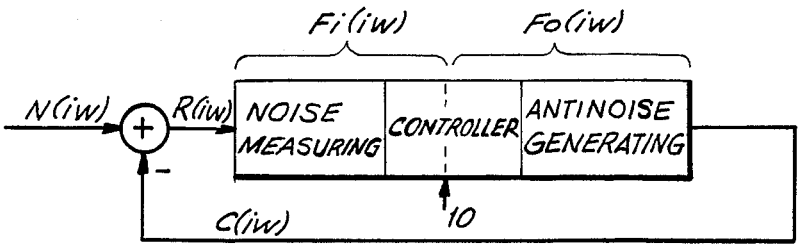
FIG. 1 is an overall view of a system for cancelling a vibration.

FIG. 1 represents the relevant parameters of any vibrating system. N(iω) is the plurality of pairs of real and imaginary components in the frequency domain which components represent the amplitude and phase of each frequency in the frequency band representing the vibration to be cancelled. C(iω) is the plurality of pairs of similar frequency components representing the frequency band of the cancelling vibration field. R(iω) is the plurality of pairs of similar frequency components representing the residual field remaining after superposition of N(iω) and C(iω). Fi(iω) is the combined transfer function of all of the system elements prior to an arbitrary reference point 10 in the system, and Fo(iω) is the combined transfer function of all the system elements after the reference point. The system reference point can in principle be chosen anywhere but since it is a position in the system to which all the equations are referred, for practical purposes it is best defined within the controller performing the transfer function generation and cancelling computations and ideally is selected -at a point which leaves Fi(iω) as sensibly, of unit value.

The invention will be described by way of the example shown in FIG. 2, which represents an acoustic cancelling system. In this example the transfer function generator is phase locked by line 11 to a source of repetitive acoustic noise.

Figure 2:
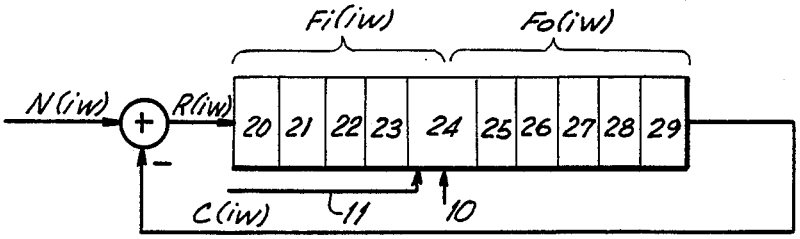
FIG. 2 is a schematic view of an acoustic system for cancelling noise.
Figure 3:
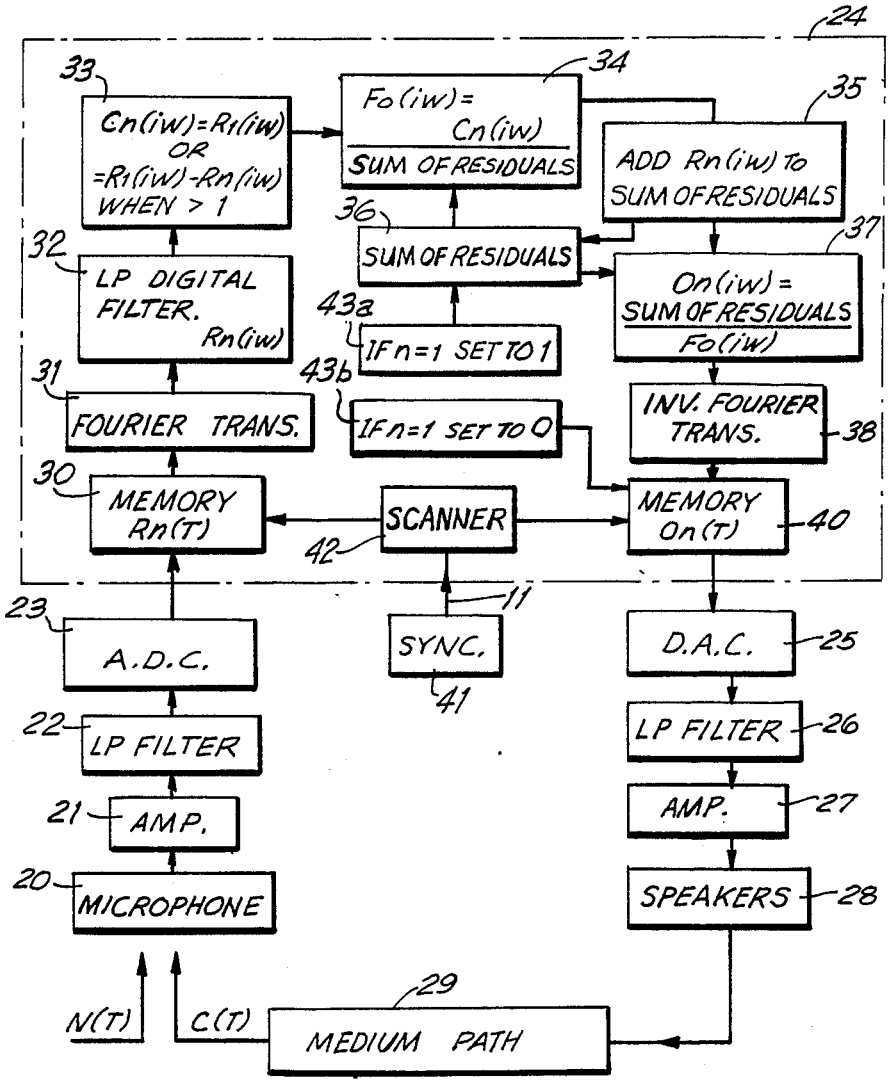
FIG. 3 is a more detailed schematic of the system of FIG. 2.

The elements of the system shown in FIG. 2 are an audio/electric transducer (a microphone) 20 to monitor the residual sound field and an audio amplifier 21 to produce an amplified output of the analogue signal generated by the microphone. 22 is a low pass filter and 23 an analogue to digital converter (ADC) which associates a numerical value to each of the different time slices into which the analogue output of the microphone 20 is divided. .24 is a microprocessor which is programmed to perform transformation operations on the output of the ADC 23 and will be described in greater detail with reference to FIG. 3. The combined transfer function (the input transfer function) of the parts 20 to 24 is collectively represented as Fi(iω) in FIG. 2.

The output transfer function Fo(iω) relates to integers 25 to 29 which sequentially represent a digital to analogue converter (DAC) 25, a low pass filter 26, a second audio power amplifier 27, an electro/acoustic transducer (a loudspeaker) 28 and the acoustic path 29 between the transducers 20 and 28.

In the described arrangement, the microprocessor 24 will undertake frequency domain manipulations based on amplitude and phase values, but it is not essential that this domain, or these parameters representative of that domain be used.

The loop shown in FIG. 2 is repetitively followed and periodically (typically each successive loop—but this need not be the case particularly in a system which is not varying significantly and is effecting good cancellation) at least the output transfer function is adjusted to maintain R(iω) at a minimum value.

Figure 4:
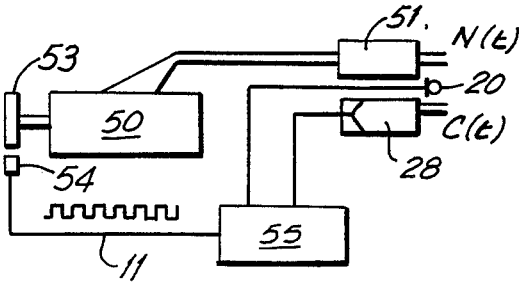
FIG. 4 is a schematic view of a practical system for cancelling noise from an engine.
Figure 5:
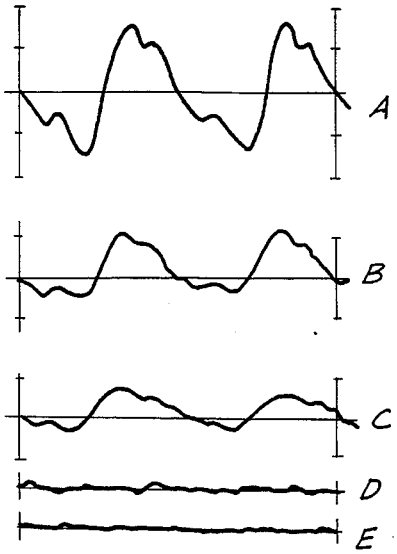
FIG. 5 is a series of graphs showing noise reduction in the exhaust from the engine of FIG. 4.

How this is done, represents the substance of the present invention and will now be further described, verbally with reference to FIGS. 3, 4 and 5, and mathematically.

From FIG. 3, in which the same reference numerals have been used as were used in FIG. 2, it can be seen that the microprocessor 24 comprises input and output memory regions (30 and 40, respectively), Fourier and inverse Fourier transformers (31 and 38 respectively), a low pass digital filter 32, a first calculator region 33 for determining a digital array representative of the current transformed cancelling vibration field $C_n(i\omega)$, a second calculator region 34 for determining a digital array representative of the output transfer function Fo(iω), a third calculator region 35 for updating a digital array representative of the sum of all previous residual transformed vibration fields by adding thereto the current residual field (Rn(iω), a memory region (36) in which the sum of previous residuals can be stored, and a fourth calculator region 37 for determining a digital array representative of the new transformed output vibration field (On(iω)) from the ratio of the sum stored in region 36 and the current output transfer function determined in calculator region 34.

The circuit shown in FIG. 3 is for processing repetitive signals and the line 11 receives signals from a sync. generator 41 and feeds them to a memory scanner 42 which sequences the input and output memories (30, 40).

A start-up unit **43*a* is used to set the total in the memory region 36 to unity for the first cycle and 43*b* to set the output memory 40** to zero for the first cycle.

The sync. generator 41 can take many forms, but one convenient practical embodiment for use with rotating machinery serving as a source of the incident vibration, comprises a timing disc (e.g. a toothed wheel) generating (say) 64 pulses each 360° rotation and rotating in synchronism with the vibration source. Such a timing disc can be made to generate a square wave pulse train with a 50:50 mark space ratio, each leading edge being used as a trigger pulse to advance the memory scanner 42 one stage. With 64 timing pulses per revolution of the timing disc, it is computationally convenient to let one repeat cycle of the microprocessor 24 represent two rotations of the disc so that the input and output memories 30, 40 each constitute 128 addresses. Working with 8-bit technology each address in memory 30 desirably comprises four bytes, one 16-bit word of each address representing the real component of a complex number and the other 16-bit word of each address representing the imaginary component of the complex number.

Considering start up conditions, all four bytes in each address of the memory 30 is set to zero and on the arrival of the first 128 timing pulses, the two bytes making up the real component of each address in memory 30 is in turn filled with the binary number generated by the ADC 25 on the basis of the amplitude of the then instantaneous output of the vibration sensor 20 (i.e. the amplitude of the incident vibration N(T) is stored in successive time slots). The addresses in the memory 30 are incremented by four bytes for each timing pulse on line 11.

Following each succeeding two rotations of the timing disc, each memory address in the memory 30 will have been updated to store the residual field $R_n(T)$ and thus has taken account of the effect of the superposition of the cancelling vibration field C(T) on the incident vibration field N(T).

A commercially available fast Fourier transformer is used for integers 31 and 38 and its mode of sequentially operating on the data in the addresses of the memory region 30 is so well documented as not to require elaboration here. It is convenient to digitally process information relating to the amplitude and phase of each Fourier transformed component and this involves storing the complex number a + ib in the first 64 addresses and a-ib in the last 64 addresses, the amplitude then being derivable from $\sqrt{a^2+b^2}$ and the phase from $\tan^{-1} b/a$. It is however not necessary to separate out the complex number into this physical form. Following Fourier transformation by chip 31, all 128×4 bytes are full of digital data, the first 64 addresses containing the complex conjugate. The dc level is located in the centre of the memory array (i.e. address 64) with the fundamental in address 1 and the negative fundamental in address 128.

To keep the computation to acceptable levels without loss of any significant degree of performance, the first calculator region 33 is designed to work on only one half of the available data (i.e. addresses 1 to 63) and furthermore only the lower frequency terms in the band of interest for active noise control achieve this.

Calculator region 33 determines a digital array representative of the transformed cancelling field after the nth loop $C_n(i\omega)$. During start-up when there is no cancelling field, the region 33 will determine $N(i\omega)$, a digital array representing the transformed incident vibration field.

The digital array in region 33 is next operated on computationally in the four stages represented in FIG. 3 by the boxes 34 to 37. Central to this calculation is a determination of a digital array representing (in the transformed domain) the sum of all previous residual vibration fields. The updating of the sum of residuals is effected in the third calculator region 35 and memory region 36 stores this for use in the second (34) and fourth (37) calculator regions. In region 34 the transfer function $Fo(i\omega)$ of the integers 24–29 is calculated from the ratio of $C_n(i\omega)$ and the sum of residuals. In region 37 the digital array representing, in the transformed domain, the output electrical waveform needed to drive the amplifier 27 is generated by taking the ratio of the sum of residuals and the output transfer function $Fo(i\omega)$. Inverse Fourier transformation is performed, the result is doubled to compensate for the power lost by not processing the conjugate part of the FFT, in unit 38 and fed into the output memory 40 comprising 128 addresses of two bytes each (since only real data is stored in the output memory 40). The addresses in the memory 40 are incremented 2 bytes for each time pulse on line 11.

Following reversion to an analogue signal in the DAC 25, filtering at 26 and amplification in 27, the cancelling vibration is generated in the transducer 28 to create, after passage through the path 29 (which could be in air, liquid and/or solid), the cancelling field C(T).

In the exemplified case, after ten or twelve rotations of the timing wheel (i.e. five or six cycles) the residual vibration field $R_n(T)$ will be at least 15 dB down on the incident vibration field N(T). As the cancellation improves the input memory comes closer to a full array of zeros.

The key to improving cancellation is the determining of an accurate value for the transfer function $Fo(i\omega)$ which, as can be seen from the second calculator region 34, is the ratio of the current cancelling field and the sum of the previous residuals.

FIG. 4 shows an IC engine 50 with an exhaust system 51, a toothed timing wheel 53, a sensor 54 for wheel teeth, a microphone 20, a speaker 28 and a unit 55 representing the units 21 to 27 of FIG. 3 between the microphone 20 and speaker 28. The timing cycle must match the repetition cycle of the engine 50 so that a 64 toothed wheel 53 will be required if its drive shaft turns twice per full cycle of engine performance.

FIG. 5 shows five typical traces of the analogue output of the microphone 20 over the first, (at A), second (at B), third (at C), fifth (at D) and fifteenth (at E) repetition cycles of the engine 50. The five traces shown in FIG. 5 are all drawn to the same scale and relate to the engine operating at constant speed, but because of the very rapid adaptive performance achieved by means of the invention, similar rapid attenuation is achieved when the rotational speed of the engine varies.

Expressed in mathematical terms, by considering the action of the system shown in FIG. 2, the following expressions can be derived for the nth loop $$C_n(i\omega) = \left[ \frac{Fi(i\omega)N(i\omega) + \sum_{K=2}^{K=n-1} R_K(i\omega)}{Fec(i\omega)} \right] Fo(i\omega) \qquad 1$$

where $Fec(i\omega)$ is the cth estimate of $Fo(i\omega)$. Note if $Fo(i\omega)$ is updated every loop then c=n. Also $$Fe(c+1)(i\omega) = \left[ \frac{N(i\omega) - R_n(i\omega)}{Fi(i\omega)\left( N(i\omega) + \sum_{K=2}^{K=n-1} R_K(i\omega) \right)} \right] Fec(i\omega) \qquad 2$$

For the special case when n=1, $N(i\omega)-R_n(i\omega)$ is replaced by $N(i\omega)$ so equation 2 reduces to $$Fe(c+1)(i\omega) = \left[ \frac{C_n(i\omega)}{Fi(i\omega) \sum_{K=1}^{K=n-1} R_K(i\omega)} \right] Fec(i\omega) \qquad 3$$

since $R_n(i\omega)=N(i\omega)-Cn(i\omega)$ and for the start-up loop $C_1(i\omega)=0$ so that the first residual is equal to $N(i\omega)$. Equations 2 and 3 give the factor required to update the all-important output transfer function, and from equation 3 can be seen to be the current cancelling field divided by the product of the input transfer function and the sum of the previous residuals. It has been found that by appropriate choice of components 20 and 21, a working approximation of the updating factor can be obtained by assuming that $Fi(i\omega)$ is unity and it will be seen that this assumption has been made in the ratio computed in region 34 of FIG. 3.

The pair of equations 1 and 2 above can be upgraded each loop, but in practice since the transfer function rapidly converges to a relatively steady value, it is acceptable practice to cease updating the transfer function each loop after such a steady value has been obtained and only to revise it when it does need recalculation. This recalculation can be at pre-determined intervals or switched in when the output from the system begins to lose cancellation efficiency.

The history of residuals can be successively weighted so that the importance of past events is reduced in the calculation of the sum.

The procedure explained with reference to FIGS. 2 and 3 will only find a transfer function value for frequencies present in $N(i\omega)$. In a non-repetitive situation, it may be necessary to find the transfer function values at other frequencies. This can be achieved by deliberately imparting additional components into the incident vibration field by the controller and eliminating these in the described manner. This is equally applicable to deterministic and random systems, where it is also possible to recompute Fec(iω) when new frequency terms appear.

The foregoing description has specified the use of Fourier components of the time domain signals and has concentrated on a repetitive system. Those skilled in the art will realize that the expressions generated for the transfer function and cancellation can be applied to any deterministic system and that the transfer function generator can be applied to random systems. Also, that any other suitable mathematical transform can be employed in place of a Fourier transform.

I claim:

1. A method for the active cancellation of an incident vibration field (N(iω)) comprising the steps of:

(i) superposing a cancelling vibration field (C(iω)) on the incident field to create a residual vibration field (R(iω));

(ii) operating on the residual field with a transfer function to obtain an updated cancelling field, the transfer function being divided by a reference point into an upstream part (Fi(iω)) and a downstream part (Fo(iω)); and (iii) periodically updating the downstream part (Fo(iω)) of the transfer function by multiplying the last obtained value ($Fo_n(i\omega)$) by a factor which is the ratio of a computational value of the last cancelling field ($C_n(i\omega)$) and a computational value for the sum of previous residual fields (R(iω)).

2. The method according to claim 1, wherein the reference point is chosen at a position in which the upstream transfer function approximates to unity.

3. The method according to claim 1, wherein the reference point is chosen at a position in which the upstream transfer function has known characteristics which can be included in the computation.

4. The method according to claim 1, wherein the updating factor is deduced using the expression $$\frac{N(i\omega) - R_n(i\omega)}{Fi(i\omega)\left(N(i\omega) + \sum_{K=2}^{K=n-1} R_K(i\omega)\right)}$$

where $R_n(i\omega)$ is the computational value of the residual field on the nth update, and for the special case where n=1, $N(i\omega)-R_n(i\omega)$ is replaced by N(iω).

5. The method according to claim 4, wherein the updating factor is taken to be $$\frac{C_n(i\omega)}{\sum_{K=1}^{K-n-1} R_K(i\omega)}$$

where $C_n(i\omega)$ is the computational value of the cancelling field on the nth update.

6. A method of updating the transfer function used in a transformed domain to determine a cancelling vibration field (C(T)) which when superposed on an incident vibration field (N(T)) will produce a residual vibration field (R(T)), the updating being effected so as to decrease the residual vibration field, the method comprising:

multiplying the existing value of the transfer function in the transformed domain ($Fo_n(i\omega)$) by an updating factor which is the ratio of the existing value of the cancelling field in the transformed domain ($C_n(i\omega)$) to the sum of all significant values of the residual field in the transformed domain.

7. The method according to claim 6, wherein the transformed domain is a Fourier transformation and the history of values of the incident vibration fields and of the residual fields are successively weighted so that the importance of past events is reduced in the calculation.

8. Apparatus for cancelling vibrations entering a given location from a source of primary, repetitive vibrations, comprising:

rate monitoring means for monitoring the repetition rate at which the source is emitting said primary vibrations;

a first electro-mechanical transducer to generate a secondary vibration and to feed said secondary vibration to said location;

a second electro-mechanical transducer to monitor the resultant vibrations existing at said location due to interaction between said primary and secondary vibrations; and an electronic digital processing circuit linking said first and second transducers, said circuit including synchronising means for receiving an electrical signal train from said rate monitoring means, a first transform module receiving time waveform samples from the second transducer and generating independent pairs of components at each of a plurality of a different frequency locations of the time waveform samples, a processor for separately modifying the independent pairs at each said frequency location outputted from the first transform module and feeding the modified pairs of components to a second transform module, said second transform module generating further time waveform samples which are fed as input to the first transducer, between said first and second transform modules said digital processing circuit including a first region in which the current transform domain representation of the secondary vibration is stored, a second region in which a transformed domain representation of the sum of earlier differences between primary and secondary vibrations is stored, and a third region in which a ratio between the data in the first and second regions is obtained.

9. The apparatus according to claim 8, wherein the transform modules are Fourier transformers.

10. The apparatus according to claim 9, wherein the data stored in the digital processing circuit includes information defining the amplitude and phase at a plurality of discrete frequencies

* * * * *

UNITED STATES PATENT AND TRADEMARK OFFICE

CERTIFICATE OF CORRECTION

PATENT NO. : 4,947,435

DATED : August 7, 1990

INVENTOR(S) : Brian A. Taylor

It is certified that error appears in the above-identified patent and that said Letters Patent is hereby corrected as shown below:

Title page, insert:

[73] Assignee: Active Noise and Vibration Technologies, Inc., Phoenix, Arizona before item [57] insert:

Attorney, Agent or Firm - Morgan & Finnegan

Signed and Sealed this

Tenth Day of December, 1991

*Attest:*

HARRY F. MANBECK, JR.

*Attesting Officer*

*Commissioner of Patents and Trademarks*